US009665036B2

(12) United States Patent
Kitan

(10) Patent No.: US 9,665,036 B2
(45) Date of Patent: May 30, 2017

(54) REGULATING MEMBER AND DEVELOPING DEVICE

(71) Applicant: CANON KABUSHIKI KAISHA, Tokyo (JP)

(72) Inventor: Tomonori Kitan, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/453,845

(22) Filed: Aug. 7, 2014

(65) Prior Publication Data

US 2015/0043952 A1 Feb. 12, 2015

(30) Foreign Application Priority Data

Aug. 9, 2013 (JP) ..... 2013-166633

(51) Int. Cl.
*G03G 15/00* (2006.01)
*G03G 15/08* (2006.01)

(52) U.S. Cl.
CPC ..... *G03G 15/081* (2013.01)

(58) Field of Classification Search
CPC ..... G03G 15/081; G03G 15/0812
USPC ..... 399/284
See application file for complete search history.

(56) References Cited

U.S. PATENT DOCUMENTS 6,397,025 B1 * 5/2002 Higeta ..... G03G 21/181 399/103
8,655,237 B2 * 2/2014 Suzuki et al. ..... 399/272
2005/0185974 A1 * 8/2005 Terai ..... G03G 15/095 399/30
2011/0064484 A1 * 3/2011 Wada et al. ..... 399/274
2013/0209142 A1 * 8/2013 Kusukawa et al. ..... 399/274
2014/0255061 A1 * 9/2014 Yasumoto et al. ..... 399/284

FOREIGN PATENT DOCUMENTS

| | | | |
|---|---|---|---|
| JP | 05-323693 B2 | | 12/1993 |
| JP | 05323693 A | * | 12/1993 |
| JP | 2001-125460 A | | 5/2001 |
| JP | 2002-214886 A | | 7/2002 |
| JP | 2004184941 A | * | 7/2004 |
| JP | 2009-175360 A | | 8/2009 |
| JP | 2012-247757 A | | 12/2012 |
| JP | 2012247757 A | * | 12/2012 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A regulating member for regulating a layer thickness of a developer includes a base portion, a regulating portion extending along a longitudinal direction of the base portion and projecting from a first surface of the base portion to regulate a layer thickness of a developer, and a rib formed along the longitudinal direction and configured to project from a second surface opposite from the first surface of the base portion. In addition, a through hole structure is provided at each end of the base portion with respect to the longitudinal direction, and configured with a through hole that passes through the base portion. The rib is provided adjacently to each through hole with respect to a direction perpendicular to the longitudinal direction, and the rib stands along each through hole in a cross-section which crosses the through hole and is perpendicular to the longitudinal direction of the base portion.

2 Claims, 9 Drawing Sheets

(a) H1 CROSS-SECTION (b) H2 CROSS-SECTION (a) H3 CROSS-SECTION (b) H4 CROSS-SECTION

REGULATING MEMBER AND DEVELOPING DEVICE

FIELD OF THE INVENTION AND RELATED ART

The present invention relates to a regulating member, including a layer thickness regulating portion for regulating a layer thickness of a developer carried on a developer carrying member, extended between bearing members for supporting the developer carrying member at end portions of the developer carrying member, and relates to a developing device including the regulating member. Specifically, the present invention relates to a structure in which an opposing gap between the developer carrying member and an image bearing member is visible.

An image forming apparatus in which an electrostatic image is developed by the developing device to form a toner image on the image bearing member, and the toner image on the image bearing member is transferred onto a recording material directly or via an intermediary transfer member, and then the toner image is fixed as an image on the recording material by heating and pressing the recording material to which the toner image is transferred has been widely used. The developing device regulates the layer thickness of the developer, carried on the developer carrying member, at a constant level by a layer thickness regulating member (doctor blade) with rotation of the developer carrying member, and feeds the developer subjected to the layer thickness regulation to an opposing portion to the image bearing member with rotation of the developer carrying member.

When the developer passes through an opposing gap between the layer thickness regulating member and the developer carrying member and is subjected to the layer thickness regulation, the layer thickness regulating member is deformed toward a direction the layer thickness regulating member is moved away from the developer carrying member by being subjected to application of pressure of the developer. In the case where the layer thickness regulating member is mounted relative to the developer carrying member while being extended between bearing members for supporting the developer carrying member at end portions of the developer carrying member, a longitudinal central portion of the layer thickness regulating member is moved away from the developer carrying member, so that there is a possibility that the layer thickness of the developer is larger at the longitudinal central portion than at longitudinal end portions. With downsizing of the image forming apparatus, when section modulus of the regulating member becomes small, a degree of flexure (bending) of the regulating member supported at the longitudinal end portions becomes large, so that a difference in developer layer thickness between the longitudinal central portion and each of the longitudinal end portions further becomes large.

In Japanese Laid-Open Patent Application (JP-A) 2002-214886, a layer thickness regulating member formed of a metal plate is provided with ribs by a drawing process, so that the section modulus of the layer thickness regulating member is enhanced. In JP-A 2009-175360, a supporting portion for a layer thickness regulating member is added to a longitudinal central portion where a degree of flexure of the layer thickness regulating member supported at longitudinal end portions is liable to increase, so that the degree of flexure of the layer thickness regulating member as a whole is decreased.

In JP-A 2012-247757, a layer thickness regulating member for regulating a layer thickness on a developer carrying member is fixed to a beam portion extended in a beam shape between a pair of supporting portions for rotatably supporting the developer carrying member at end portions of the developer carrying member, so that a degree of flexural stress acting on the layer thickness regulating member is alleviated compared with those in JP-A 2002-214886 and JP-A 2009-175360. In JP-A 2012-247757, the developer carrying member, the pair of supporting portions and the layer thickness regulating member are integrally assembled into a unit, and the units is detachably mounted to a developing device.

A gap (spacing) where the image bearing member and the developer carrying member oppose each other is an important parameter largely relating to a developing performance of the developing device. When the developer carrying member is obliquely assembled with the image bearing member, a difference in developing performance is generated between end portions of the developer carrying member with respect to a rotational axis direction of the developer carrying member, so that an image density largely varies. Even when the developer carrying member is assembled in parallel with the developer carrying member, if an interval (distance) of the gap between the image bearing member and the developer carrying member varies every developing device, the image density of an output image for each of the image forming apparatuses changes. For that reason, in the image forming apparatus, after the developer carrying member is assembled with the image bearing member, the interval of the gap between the image bearing member and the developer carrying member is required to be measured and adjusted to a standard value.

Incidentally, for example, as described in JP-A 2012-247757, in a constitution in which the developer carrying member, the pair of supporting portions, the beam portion and the layer thickness regulating member are exchangeable (replaceable) as a unit, it was proposed that the number of components was reduced by integrally assembling the layer thickness regulating member with the beam portion from the start. A constitution in which a layer thickness regulating portion as a separate member is fixed in advance to the beam portion to be extended between the supporting portions for supporting the end portions of the developer carrying member and a constitution in which the layer thickness regulating portion and the beam portion are integrally formed of the same material are employed (FIG. 8).

In these cases, in order to enhance flexural rigidity of the member obtained by integrally assembling the beam portion and the layer thickness regulating portion into a unit, it would be considered that a cross-section of the beam portion (member) is expanded toward the image bearing member along a cross-section perpendicular to an axis (shaft) of the developer carrying member. In this case, it would be considered that an overhang-like portion, of the layer thickness regulating portion, expanded toward the image bearing member covers the gap between the developer carrying member and the image bearing member, so that it is difficult to observe a state of the gap after the assembling.

SUMMARY OF THE INVENTION

A principal object of the present invention is to provide a regulating member permitting visual recognition of a gap (interval) between an image bearing member and a developer carrying member from an outside in an assembled state even in the case where a cross-section thereof is expanded to a close position to the image bearing member.

Another object of the present invention is to provide a developing device including the regulating member.

According to an aspect of the present invention, there is provided a regulating member for regulating a layer thickness of a developer carried on a developer carrying member, comprising: a regulating portion for regulating the layer thickness of the developer carried on the developer carrying member; an opposing portion provided integrally with the regulating portion at an opposing position to the developer carrying member, wherein the opposing portion is provided so as to cover a rectilinear line passing through a developing gap formed, when the regulating member is mounted relative to the developer carrying member, with a predetermined interval between the developer carrying member and an image bearing member on which a latent image to be developed by the developer carrying member is formed; and an opening provided on the rectilinear line passing through the developing gap at the opposing portion.

According to another aspect of the present invention, there is provided a developing device comprising: a developer carrying member for carrying a developer; a regulating member for regulating a layer thickness of the developer carried on the developer carrying member; an opposing portion provided integrally with the regulating member at an opposing position to the developer carrying member, wherein the opposing portion is provided so as to cover a rectilinear line passing through a developing gap formed, when the regulating member is mounted relative to the developer carrying member, with a predetermined gap between the developer carrying member and an image bearing member on which a latent image to be developed by the developer carrying member; an opening provided on the rectilinear line passing through the developing gap of the opposing portion; a casing including an accommodating space for accommodating the developer carrying member and the regulating member in an integrally assembled state; an adjusting mechanism capable of adjusting a distance between a center of the image bearing member and a center of the developer carrying member; and a cap member, connected with the casing, capable of opening a part of the accommodating space, wherein the predetermined gap is visible through the opening from an opening portion of the casing from which the cap member is dismounted.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings.

(Image Forming Apparatus)

Figure 1:
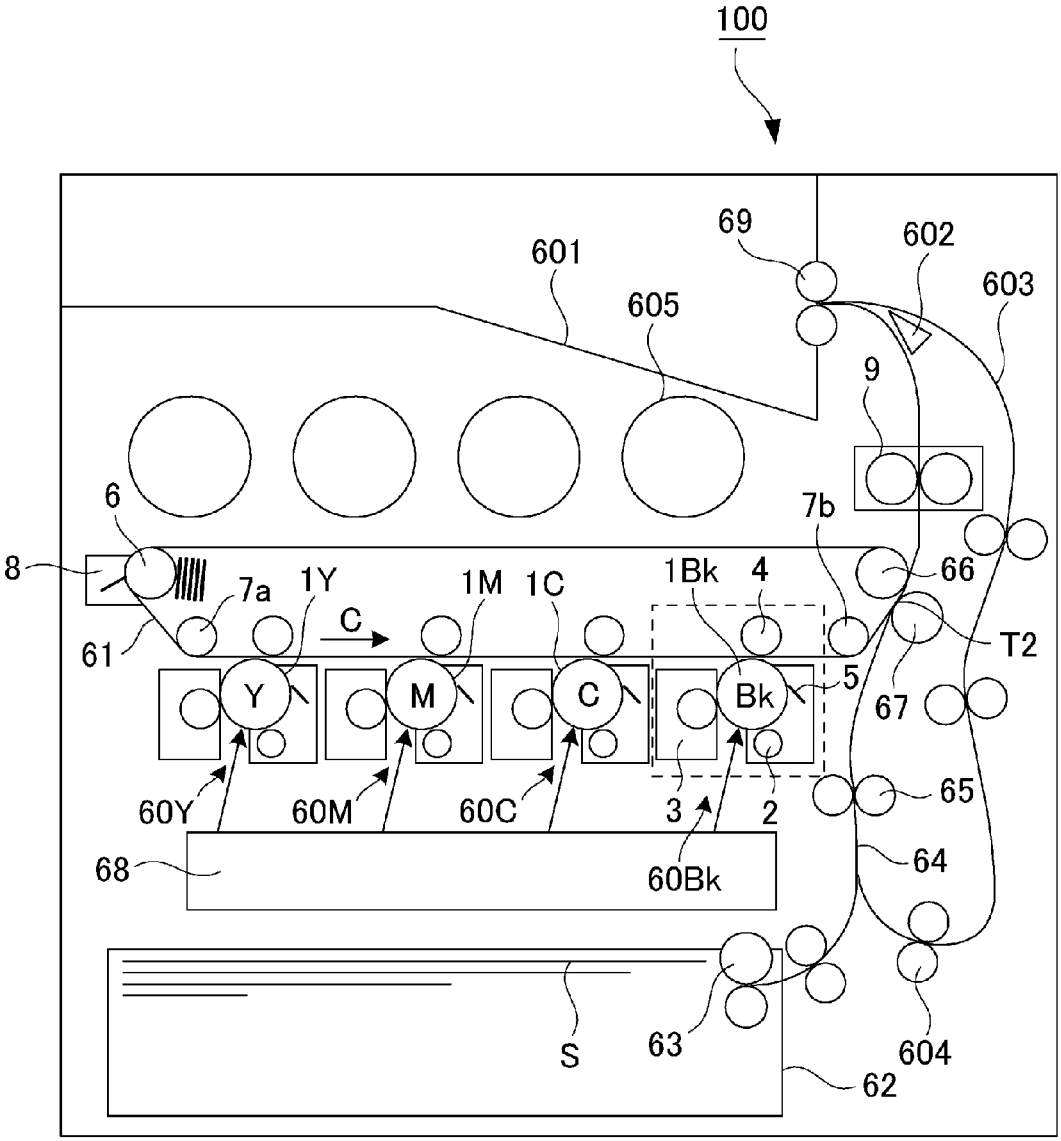
FIG. 1 is an illustration of a structure of an image forming apparatus.

FIG. 1 is an illustration of a structure of an image forming apparatus 100. As shown in FIG. 1, the image forming apparatus 100 is an intermediary transfer type full color printer of a tandem type in which image forming portions 60Y, 60M, 60C and 60Bk are arranged along a downward surface of an intermediary transfer belt 61.

At the image forming portion 60Y, a yellow toner image is formed on a photosensitive drum 1Y and then is transferred onto the intermediary transfer belt 61. At the image forming portion 60M, a magenta toner image is formed on a photosensitive drum 1M and then is transferred onto the intermediary transfer belt 61. At the image forming portions 60C and 60Bk, cyan and black toner images are formed on photosensitive drums 1C and 1Bk, respectively, and then are transferred onto the intermediary transfer belt 61.

The four color toner images transferred on the intermediary transfer belt 61 are conveyed to a secondary transfer portion T2 and are secondary-transferred onto the recording material S. A separation roller 63 separates sheets of the recording material S, one by one, pulled out from a recording material cassette 62, and then feeds the recording material S to a registration roller pair 65. The registration roller pair 65 sends the recording material S to the secondary transfer portion T2 while being timed to the toner images on the intermediary transfer belt 61. The recording material P on which the four color toner images are secondary-transferred is pressed and heated by a fixing device 9, so that the toner images are fixed on a surface of the recording material S.

In the case of one-side image formation, the recording material S on which surface the toner image is fixed is discharged onto an upper tray 601 through a discharging roller 69. On the other hand, in the case of double-side image formation, the recording material S is fed until a trailing end thereof passes through a switching flapper 602, and thereafter a leading end and the trailing end are changed and the recording material S is fed to a feeding path 603 again by a feeding roller pair 604. Then, the recording material S is fed to the secondary transfer portion T2 by the registration roller pair 65, and then image formation on the back surface of the recording material S is carried out.

The image forming portions 60Y, 60M, 60C and 60Bk have the substantially same constitution except that colors of toners used in developing devices 3 are yellow, magenta, cyan and black, respectively, which are different from each other. In the following, the image forming portion 60Bk is described, and redundant explanation about other image forming portions 60Y, 60M and 60C will be omitted.

The image forming portion 60Bk includes, at a periphery of the photosensitive drum 1Bk, a charging device 2, an exposure device 68, the developing device 3, a transfer roller 4 and a drum cleaning device 5. The photosensitive drum 1Bk is prepared by forming a photosensitive layer on an outer peripheral surface of an aluminum cylinder, and is rotated at a predetermined process speed.

The charging device 2 electrically charges a surface of the photosensitive drum 1Bk to a negative potential uniformly by applying, to a charging roller rotated by the photosensitive drum 1Bk, an oscillating voltage in the form of a negative(-polarity) DC voltage biased with an AC voltage. The exposure device 68 scans the surface of the photosensitive drum 1K with a laser beam, obtained by ON-OFF modulation of a scanning line image signal developed from an associated color image, through a rotating mirror, so that an electrostatic image for an image is written (formed) on the surface of the photosensitive drum 1Bk. The developing device 3 develops the electrostatic image into a toner image by transferring the toner onto the photosensitive drum 1Bk. A fresh toner in an amount corresponding to an amount of the toner consumed in the developing device 3 by image formation is supplied from a toner cartridge 605, set in the image forming apparatus 100, to the developing device 3 via an unshown toner feeding path.

The transfer roller 4 presses the intermediary transfer belt 61 to form a transfer portion between the photosensitive drum 1Bk and the intermediary transfer belt 61. By applying a positive DC voltage to the transfer roller 4, the negative toner image carried on the photosensitive drum 1Bk is transferred onto the intermediary transfer belt 61. The drum cleaning device 5 removes a transfer residual toner deposited on the surface of the photosensitive drum 1Bk by sliding a cleaning blade on the surface of the photosensitive drum 1Bk.

The intermediary transfer belt 61 is extended around and supported by a tension roller 6, a driving roller 66 also functioning as a secondary transfer opposite roller, and stretching rollers 7*a* and 7*b*, and is driven by the driving roller 66 to be rotated in an arrow C direction. A secondary transfer roller 67 contacts the intermediary transfer belt 61 supported at an inside surface thereof by the driving roller 66 to form the secondary transfer portion T2. By applying a positive DC voltage to the secondary transfer roller 67, the toner image on the intermediary transfer belt 61 is transferred onto the recording material S. A belt cleaning device 8 collects the transfer residual toner on the surface of the intermediary transfer belt 61 by rubbing the intermediary transfer belt 61 with a cleaning blade.

Embodiment 1

Figure 2:
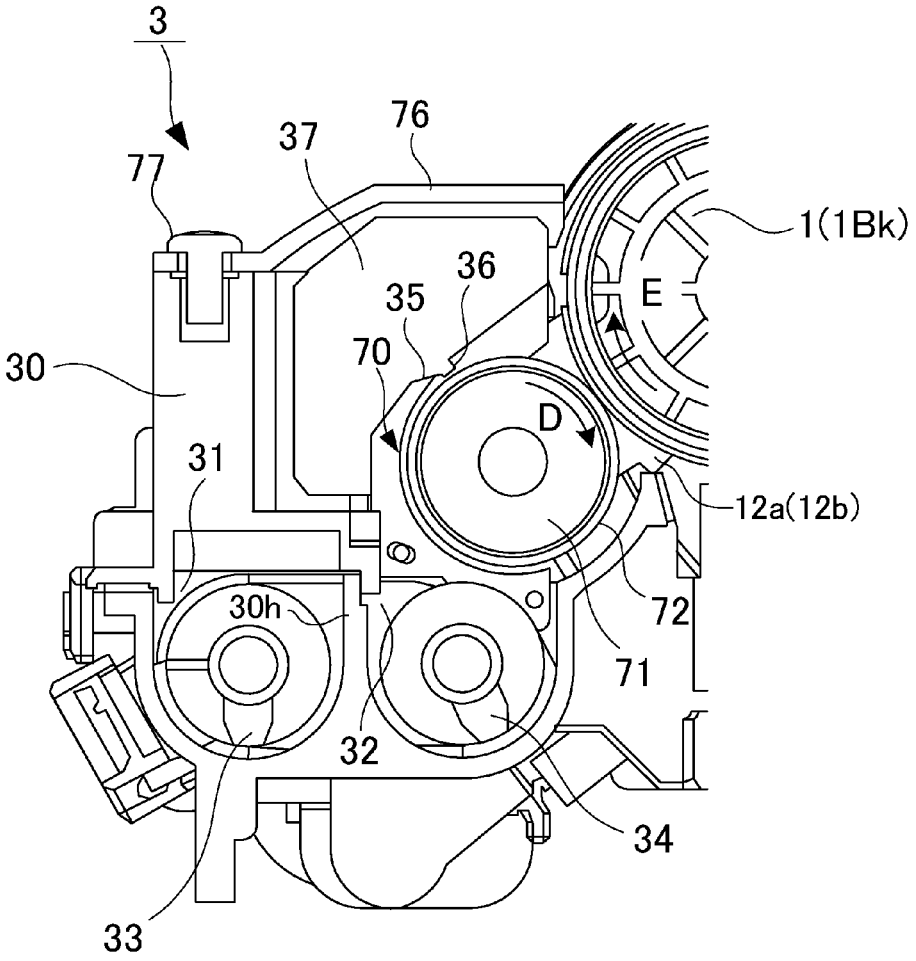
FIG. 2 is an illustration of a structure of a developing device in Embodiment 1.

As shown in FIG. 2, a developing sleeve 70 as an example of a developer carrying member carries the developer and rotates with a predetermined gap from the photosensitive drum 1 as an example of an image bearing member. A developing container 30 as an example of a casing includes an accommodating space for accommodating a developing sleeve 70, sleeve bearing members 11*a* and 11*b* and a regulating member 37 in an integrally assembled state. A cover 76 as an example of a cap member is connected with the developing container 30 by using screws 77, and thus is capable of opening a part of the accommodating space.

Figure 3:
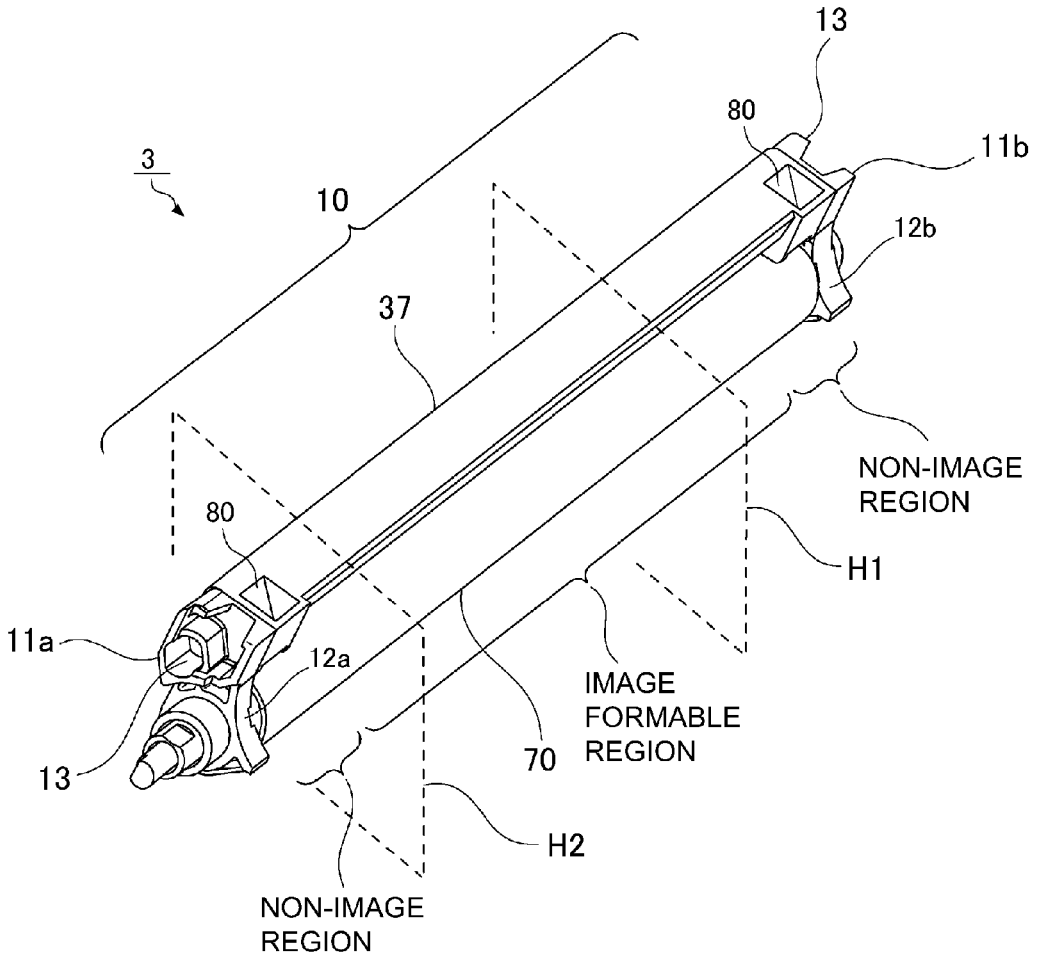
FIG. 3 is an illustration of a structure of a sleeve holder unit in Embodiment 1.

As shown in FIG. 3, with respect to the sleeve bearing members 11*a* and 11*b* as an example of a supporting member and the regulating member 37, the sleeve bearing members 11*a* and 11*b* as an example of a pair of bearing members rotatably support the developing sleeve 70 at end portions. An opening 80 is positioned outside a developing region (image formable region) and is disposed so as to oppose an SD gap at each of end portions of the regulating member 37.

Figure 4:
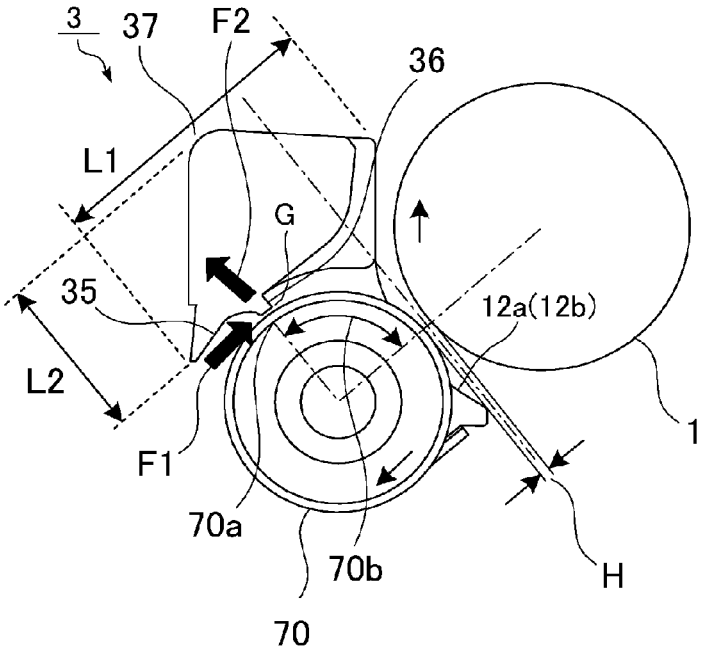
In FIG. 4, (a) and (b) are illustrations of an assembled state of a sleeve holder unit and a photosensitive drum.
Figure 4:
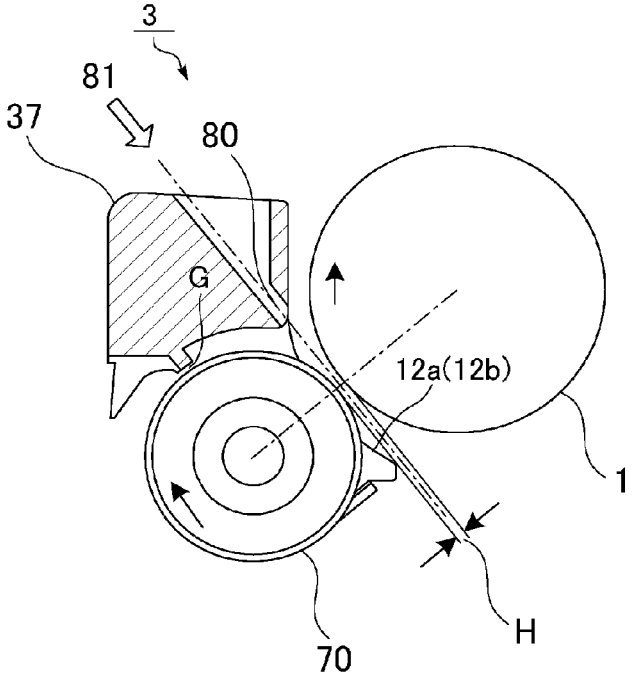

As shown in (a) of FIG. 4, the regulating member 37 as an example of a regulating member includes a layer thickness regulating portion 36 for regulating a layer thickness of the developer carried on the developing sleeve 70, and is fixed to the sleeve bearing members 11*a* and 11*b* at end portions thereof. The layer thickness regulating portion 36 is integrally formed with the regulating member 37 by using the same material. The regulating member 37 has a cross-section shape, expanded (extended) toward a downstream side of the layer thickness regulating portion 36 with respect to a rotational direction of the developer carrying member, so as to cover the above-described predetermined gap in a cross-section perpendicular to an axis of the developing sleeve 70.

As shown in (b) of FIG. 4, the regulating member 37 as an example of at least one of the bearing member and the regulating member is provided with the opening 80, as an example of an opening, formed so as to permit penetration therethrough of a phantom rectilinear line passing through the predetermined gap. The opening 80 is formed at a portion where the cross-section shape of the regulating member 37 is extended toward the downstream side of the rotational direction of the developer carrying member. From an opening portion of the developing container 30 (FIG. 2) from which the cover 76 (FIG. 2) is removed, the predetermined gap is visible (visually recognizable) through the opening 80.

Figure 5:
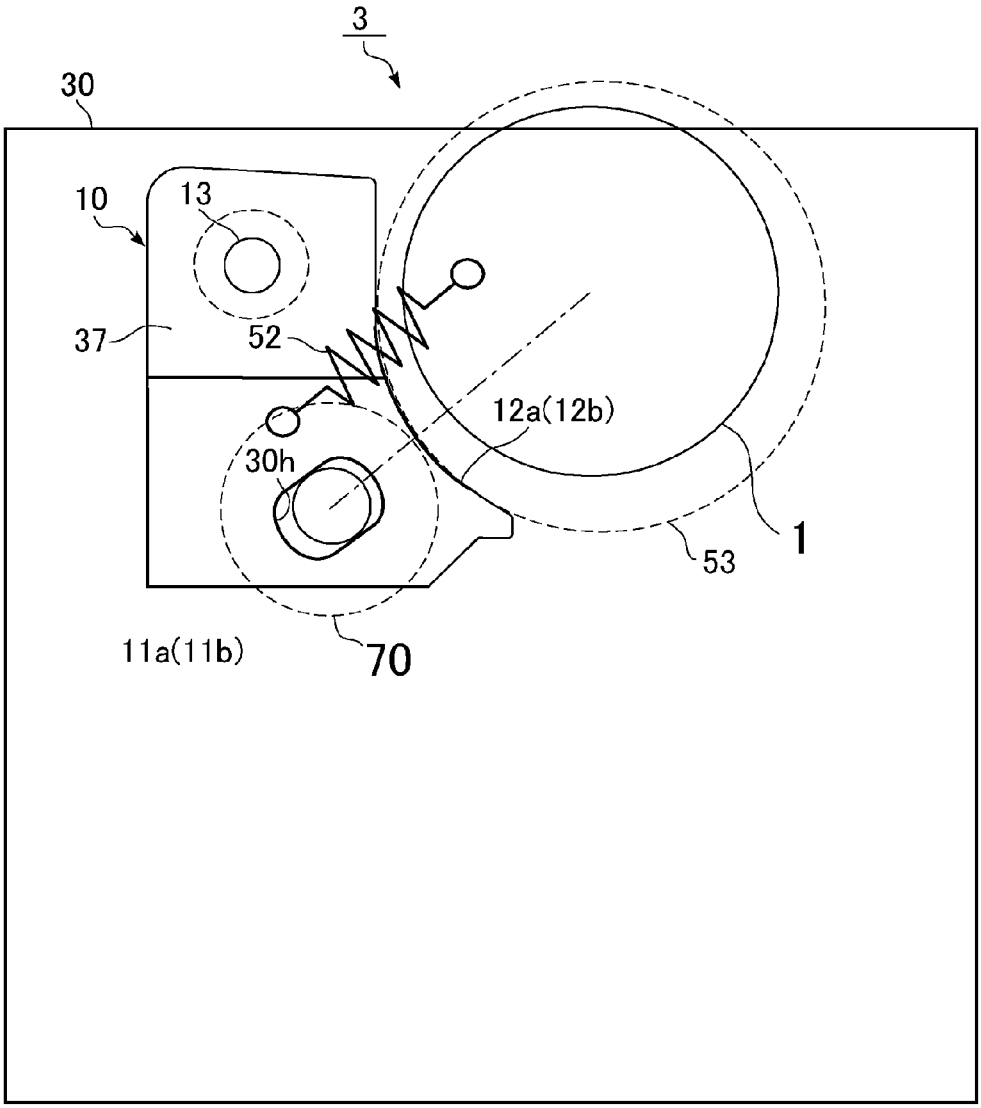
FIG. 5 is an illustration of an opposing interval (gap) between a developing sleeve and the photosensitive drum.

As shown in FIG. 5, the image forming portion 60Bk (FIG. 1) as an example of a process cartridge includes an adjusting ring 53 as an example of an adjusting mechanism. The adjusting ring 53 is capable of individually adjusting a distance between a center of the developing sleeve 70 and a center of the photosensitive drum 1 at each of the end portions of the developing sleeve 70.

(Developing Device)

FIG. 2 is an illustration of a structure of the developing device 3 in Embodiment 1. As shown in FIG. 2, in the developing device 3, a two-component developer containing a (non-magnetic) toner and a (magnetic) carrier in mixture is used to visualize the electrostatic image on the photosensitive drum 1Bk. The developing device 3 electrically charges the developer stored in the developing container 30, and then develops the electrostatic image on the photosensitive drum 1Bk into the toner image while carrying the charged developer on the surface of the developing sleeve 70.

The developing device 3 includes the developing sleeve 70 at an opening toward the photosensitive drum 1Bk. The developing sleeve 70 is supported rotatably relative to the developing container 30 at end portions thereof. Below the developing sleeve 70, a first feeding screw 33 and a second feeding screw 34 are provided. The developing sleeve 70 and the first and second feeding screws 33 and 34 are rotationally driven integrally by being connected with gear trains provided at associated shaft ends outside the developing container 30.

The developing container 30 is partitioned into a first feeding chamber 31 and a second feeding chamber 32 by a partition wall 30*h*. The first and second feeding chambers 31 and 32 communicate with each other through an opening, of the partition wall 30*h*, formed at each of longitudinal end portions of the partition wall 30*h*. The first feeding screw 33 is disposed in the first feeding chamber 31, and the second feeding screw 34 is disposed in the second feeding chamber 32. By driving the first and second feeding screws 33 and 34, the developer is delivered through the openings of the partition wall 30*h*, so that the developer is circulated between the first and second feeding chambers 31 and 32. In a process in which the developer is fed while being stirred by the first and second feeding screws 33 and 34, the carrier and the toner in the developer are triboelectrically charged to the positive polarity and the negative polarity, respectively.

The developing sleeve 70 is supported rotatably around a magnet portion 71 supported non-rotatably, and opposes the second feeding screw 34 with respect to a circumferential direction. The second feeding screw 34 supplies the developer to the developing sleeve 70 while feeding the developer in the second feeding chamber 32. The developer supplied from the second feeding screw 34 is carried on the surface of the developing sleeve 70 by a magnetic force of the magnet portion 71 and is fed in an arrow D direction.

The magnet portion 71 generates a desired magnetic field for magnetically carrying the developer on the surface of the developing sleeve 70 by forming a desired magnetic pattern on the surface of the rotating developing sleeve 70. Magnetic poles of the magnet portion 71 are fixed at predetermined phase positions with respect to the circumferential direction and are supported non-rotatably, and therefore magnetic pole patterns of the magnet portion 71 are fixed at predetermined phases with respect to the circumferential direction. Around the magnet portion 71, only a sleeve pipe 72 constituting an outer shell of the developing sleeve 70 is supported rotatably. The carrier and the toner in the developer are carried in an erected chain shape on the surface of the developing sleeve 70 in a deposited state by triboelectric charge at associated magnetic polarity positions of the magnet portion 71.

The layer thickness regulating member (sleeve holder frame) 37 is disposed so that a free end of the layer thickness regulating portion 36 opposes the surface of the developing sleeve 70. The erected chain-shaped developer deposited by the magnetic field of the developing sleeve 70 is carried and fed toward the layer thickness regulating portion 36. A gap between the free end surface of the layer thickness regulating portion 36 and the surface of the developing sleeve 70 is set in a desired range, and therefore the erected chain-shaped developer forms a uniform thickness coating layer by passing through the layer thickness regulating portion 36.

(Process Cartridge)

As shown in FIG. 1, each of the image forming portions 60Y, 60M, 60C and 60Bk is the process cartridge, as an exchangeable (replaceable) unit for the associated one of the colors, obtained by integrally assembling constituent images from which the exposure device 68 and the transfer roller 4 are removed. Each of the image forming portions 60Y, 60M, 60C and 60Bk is detachably mounted to an apparatus main assembly frame of the image forming apparatus 100. The transfer roller 4 is incorporated in an intermediary transfer unit including an intermediary transfer belt 61. The image forming portion 60Bk including the developing device 3 is integrally constituted as a unit and is made detachably mountable to the image forming apparatus 100.

Incidentally, depending on the image forming apparatus, a drum cleaning device 5 is constituted as an independent exchangeable unit is some cases. There is also the case where the drum cleaning device 5 and the charging device 2 are constituted as an independent exchangeable unit, and the photosensitive drum 1Bk and the developing device 3 are constituted as a single process cartridge.

(Feature of Embodiment 1)

FIG. 3 is an illustration of a structure of a sleeve holder unit in Embodiment 1. In FIG. 4, (a) and (b) are illustrations of an assembled state of the sleeve holder unit and the photosensitive drum. In FIG. 4, (a) shows an operation during image formation in a cross-section in an image region, and (b) shows an operation during the image formation in a cross-section in a region outside the image region.

As shown in FIG. 2, the regulating member (sleeve holder frame) 37 uniformizes the layer thickness of the developer on the surface of the developing sleeve 70 and thus realizes stable developer supply onto the photosensitive drum 1Bk. The regulating member 37 integrally includes a developer rectifying portion 35 and the layer thickness regulating portion 36, and causes a free end portion of the layer thickness regulating portion 36 to oppose the surface of the developing sleeve 70. The developer rectifying portion 35 functions as a guide at the time of feeding the developer in the upstream side of the layer thickness regulating portion 36, and guides the developer, deposited on the surface of the developing sleeve 70 and carried by the developing sleeve 70, to the opposing interval (gap) between the developing sleeve 70 and the layer thickness regulating portion 36 while placing the developer in a substantially uniform pressure state with respect to a longitudinal direction. The layer thickness regulating portion 36 cuts a magnetic chain of the developer, deposited on the surface of the developing sleeve 70, in a predetermined length. The magnetic chain of the developer formed by the magnetic field of the developing sleeve 70 constitutes a coating layer having a uniform thickness by passing through the opposing interval (SB gap G shown in FIG. 4) between the developing sleeve 70 and the layer thickness regulating portion 36.

As shown in FIG. 3, the developing sleeve 70, the sleeve bearing members 11*a* and 11*b* and the regulating member 37 which are formed as separate members are adjusted and assembled to constitute a sleeve holder unit 10. The regulating member 37 supports the developing sleeve 70 by the sleeve bearing members 11*a* and 11*b* provided at end portions thereof.

The regulating member 37 is formed of a metal material, such as aluminum, which is non-magnetic and which has strength. At the end portion of the regulating member 37 is a front side, the sleeve bearing member 11*a* including a bearing for supporting rotatably the front-side end portion of the developing sleeve 70 is fixed by welding. At the end portion of the regulating member 37 in a rear side, the sleeve bearing member 11*b* including a bearing for supporting rotatably the rear-side end portion of the developing sleeve 70 is fixed by welding. The developing sleeve 70 is rotatably supported by the sleeve bearing members 11*a* and 11*b*.

As shown in (a) of FIG. 4, a gap at a closest portion where the developing sleeve 70 and the layer thickness regulating portion oppose each other is referred to as a SB gap G. The SB gap G is defined at the free end portion of the layer thickness regulating portion 36, and is required to be set in a desired range in order to obtain an optimum developed image density. With respect to the SB gap G, accuracy of about ±30-50 μm is required to be ensured over an entire longitudinal direction. Further, longitudinal straightness of a regulating surface of the layer thickness regulating portion 36 is required to be ensured with accuracy of, e.g., 30 μm or less in order to uniformize a coating amount of the developer on the surface of the developing sleeve 70. Further, the regulating member 37 is required to have sufficient rigidity such that the regulating member 37 is not flexed (bent) by reaction force, from the developer generated when the coating amount of the developer on the surface of the developing sleeve 70 is uniformed. In a state in which such high accuracy is imparted to the SB gap G, a positional relationship among the developing sleeve 70, the sleeve bearing members 11*a* and 11*b* and the regulating member 37 is fixed invariantly.

As shown in (a) of FIG. 4, during the image formation, the regulating member 37 is subjected to application of reaction force F1 at the layer thickness regulating portion 36. The reaction force F1 is generated by collision when the developer deposited on the surface of the developing sleeve 70 is rotated and fed together with the developing sleeve 70. The direction of the reaction force F1 varies depending on a shape of the developer rectifying portion 35, but roughly coincides with a tangential direction at an outer circumference point 70*a* of the developing sleeve 70 opposing the layer thickness regulating portion 36. In order to provide strength against the reaction force F1, the regulating member 37 is formed by extending the cross-section shape so as to elongate in a direction L1 in parallel to a direction of the reaction force F1.

As shown in (a) of FIG. 4, during the image formation, the regulating member 37 is subjected to application of reaction force F2 at the layer thickness regulating portion 36. The reaction force F2 is reaction force of pressure applied when the developer passes through the gap between the layer thickness regulating portion 36 and the developing sleeve 70. The direction of the reaction force F2 varies depending on a shape of the developer rectifying portion 35, but roughly coincides with a diameter direction perpendicular to a tangential direction at an outer circumference point 70*a* of the developing sleeve 70 opposing the layer thickness regulating portion 36. In order to provide strength against the reaction force F2, the regulating member 37 is formed by extending the cross-section shape so as to elongate in a direction L2 in parallel to a direction of the reaction force F2.

In this embodiment, an angle 70*b* formed between a line segment connecting rotation centers of the developing sleeve 70 and the photosensitive drum 1 and a line segment connecting the outer circumference point 70*a* opposing the layer thickness regulating portion 36 and the center of the developing sleeve 70 is approximately 90 degrees. For this reason, the elongation (extension) direction L1 of the cross-section of the regulating member 37 is substantially parallel to the line segment connecting the centers of the developing sleeve 70 and the photosensitive drum 1. As a result, the cross-section of the regulating member 37 largely projects toward the photosensitive drum 1 to prevent a gap (SD gap) between the developing sleeve 70 and the photosensitive drum 1 from being visually recognized from above.

As shown in FIG. 3, at each of the end portions of the regulating member 37, the opening 80 for permitting visual recognition of the gap (SD gap) between the developing sleeve 70 and the photosensitive drum 1 from above while penetrating through the regulating member 37 is provided. The opening 80 is provided in the regulating member 37 correspondingly to a non-image region of the photosensitive drum 1.

As shown in (b) of FIG. 4, in a cross-section H2 of the regulating member 37 in the non-image region, the opening 80 ranging in an arrow 81 direction in which a sight line to the SD gap between the developing sleeve 70 and the photosensitive drum 1 is ensured. The shapes of the cross-sections H2 at the front-side end portion and the rear-side end portion of the developing sleeve 70 are formed in a symmetrical manner. For this reason, the shape of the cross-section H2 at the front-side end portion is described and will be omitted from redundant description.

The cross-section H2 of the regulating member 37 in the non-image region has the substantially same outer configuration as the cross-section H1 of the regulating member 37 in the image (formable) region, and therefore the regulating member 37 ensures sufficient cross-sectional area and rigidity at the end portions thereof for being connected with the sleeve bearing members 11*a* and 11*b*. The opening 80 is larger in width than the SD gap.

(Adjustment of SG Gap)

As shown in FIG. 3, adjustment of the SB gap G is made by moving the regulating member 37 relative to the sleeve bearing members 11*a* and 11*b* assembled with the developing sleeve 70 by being supported on an unshown supporting table when the sleeve holder unit 10 is adjusted and assembled. The cross-section of the regulating member 37 is positioned so that the opposing interval between the developing sleeve 70 and the layer thickness regulating portion 36 falls within a predetermined dimensional range, and then the regulating member 37 and the sleeve bearing members 11*a* and 11*b* are integrally welded.

The opposing interval between the developing sleeve 70 and the layer thickness regulating portion 36 is shot by a digital camera or the like, and then a shot image is (image-) processed, so that a value of the SB gap G can be obtained. Alternatively, the value of the SB gap G can be obtained by gap measurement with laser light.

In a state in which only the regulating member 37 and the developing sleeve 70 are disposed, the regulating member 37 and the sleeve bearing members 11*a* and 11*b* are integrally fixed by using a precision jig (tool). The SB gap G is adjusted so that a value thereof falls within a desired range at each of the longitudinal end portions of the regulating member 37, and then the sleeve bearing members 11*a* and 11*b* are bonded to the regulating member 37, thus being integrally fixed. The regulating member 37 is fixed to the sleeve bearing members 11*a* and 11*b* while maintaining accuracy of the SB gap G by the adjustment.

When an external force is strongly applied when the regulating member 37 is fixed to the sleeve bearing members 11*a* and 11*b*, there is a possibility of generation of permanent deformation due to bending and distortion of the regulating member 37. For this reason, the bonding of the end portions of the regulating member 37 to the sleeve bearing members 11*a* and 11*b* may desirably be made by a stress-free method, such as laser welding or UV bonding, carried out in a normal-temperature environment. The bonding and the welding is cited as an example of a stress-free bonding method at a normal temperature. As far as Embodiment 1 is concerned, screw fastening is not desirable because there is a possibility of generation of distortion of the regulating member 37 during the fastening. As far as Embodiment 1 is concerned, arc welding and gas welding are not desirable because there is a possibility that they cause deformation at high temperatures and flexure due to residual stress.

(Adjustment of SD Gap)

FIG. 5 is an illustration of adjustment of the opposing interval (gap) between the developing sleeve 70 and the photosensitive drum 1. As shown in (b) of FIG. 4, in a state in which a positional relationship between the developing sleeve 70 and the regulating member 37 is fixed, the sleeve holder unit 10 and the photosensitive drum 1 are connected with each other. The opposing interval between the developing sleeve 70 and the photosensitive drum 1 is referred to as a SD gap H. In order to obtain a good image, it is important to precisely adjust the SD gap H at a predetermined value over the entire image (formable) region along the developing sleeve 70. For this reason, the interval between the photosensitive drum 1 and the developing sleeve 70 is actually measured, and then adjustment and assembling between the photosensitive drum 1 and the developing sleeve 70 are carried out.

A gap gage of 300 μm in thickness is inserted into the SD gap in the arrow 81 direction through the opening 80 provided at each of the end portions of the developing sleeve 70. A center distance between the photosensitive drum 1 and the developing sleeve 70, i.e., a distance between the center of the photosensitive drum 1 and the center of the developing sleeve 70, is adjusted by using the gap gage as a spacer. The SD gap H is adjusted at a desired value by abutment of the developing sleeve 70 and the photosensitive drum 1 with the gap gage inserted therebetween. The same operation is performed in each of the front and rear sides of the photosensitive drum 1, so that the developing sleeve 70 and the photosensitive drum 1 are assembled in substantially parallel to each other with a predetermined interval.

Incidentally, scanning is made by irradiation with laser light through the opening 80 to detect reflected light, and thus the SD gap H may also be measured. It is possible to adjust the center distance between the photosensitive drum 1 and the developing sleeve 70 at a predetermined opposing interval while conducting the measurement.

As shown in FIG. 3, the sleeve bearing members 11*a* and 11*b* are provided with abutting portions 12*a* and 12*b*, respectively, for defining a distance between a rotation shaft of the developing sleeve 70 and the surface of the photosensitive drum 1. To each of the sleeve bearing members 11*a* and 11*b*, a swingable shaft 13 for swingably mounting the sleeve holder unit 10 relatively to the developing container (FIG. 2) is mounted.

As shown in FIG. 5, the sleeve holder unit 10 is connected with the developing container 30 by the swingable shafts 13. An urging spring 52 presses a whole of the sleeve holder unit 10 toward the photosensitive drum 1. In this state, the abutting portions 12*a* and 12*b* abut against the adjusting ring 53, so that the SD gap H is ensured between the photosensitive drum 1 and the developing sleeve 70. The adjusting ring 53 has an eccentric peripheral surface relative to the rotation center of the photosensitive drum 1, and is mounted to the developing container 30 in a manually rotatable manner. By manually rotating the adjusting ring 53 disposed at each of the end portions of the developing container 30, in each of the front and rear sides of the developing sleeve 70, the center between the photosensitive drum 1 and the developing sleeve 70 is adjustable.

(Effect of Embodiment 1)

In the developing device 3 in Embodiment 1, even when the regulating member (sleeve holder frame) 37 is formed of an inexpensive material having low rigidity, necessary rigidity can be ensured by the cross-section shape projecting toward the photosensitive drum 1. In the developing device 3 in Embodiment 1, the SB gap G which is the interval between the developing sleeve 70 and the layer thickness regulating portion 36 is held and fixed with high accuracy, and thereafter the SD gap H which is the interval between the photosensitive drum 1 and the developing sleeve 70 can be adjusted and assembled with high accuracy.

In the developing device 3 in Embodiment 1, the SG gap G and the SD gap H can be set precisely and stably with high reproducibility, and therefore it is possible to provide a further downsized process cartridge. The developing device 3 in Embodiment 1 is capable of compatibly realizing reductions in size and weight of the process cartridge and stabilization of image density.

In the developing device in Embodiment 1, the regulating member 37 is provided with the gap 80 correspondingly to the non-image region of the photosensitive drum 1, and therefore even when the surface of the photosensitive drum 1 is damaged during insertion and removal of the gap gage, an image quality is not impaired.

Embodiment 2

Figure 6:
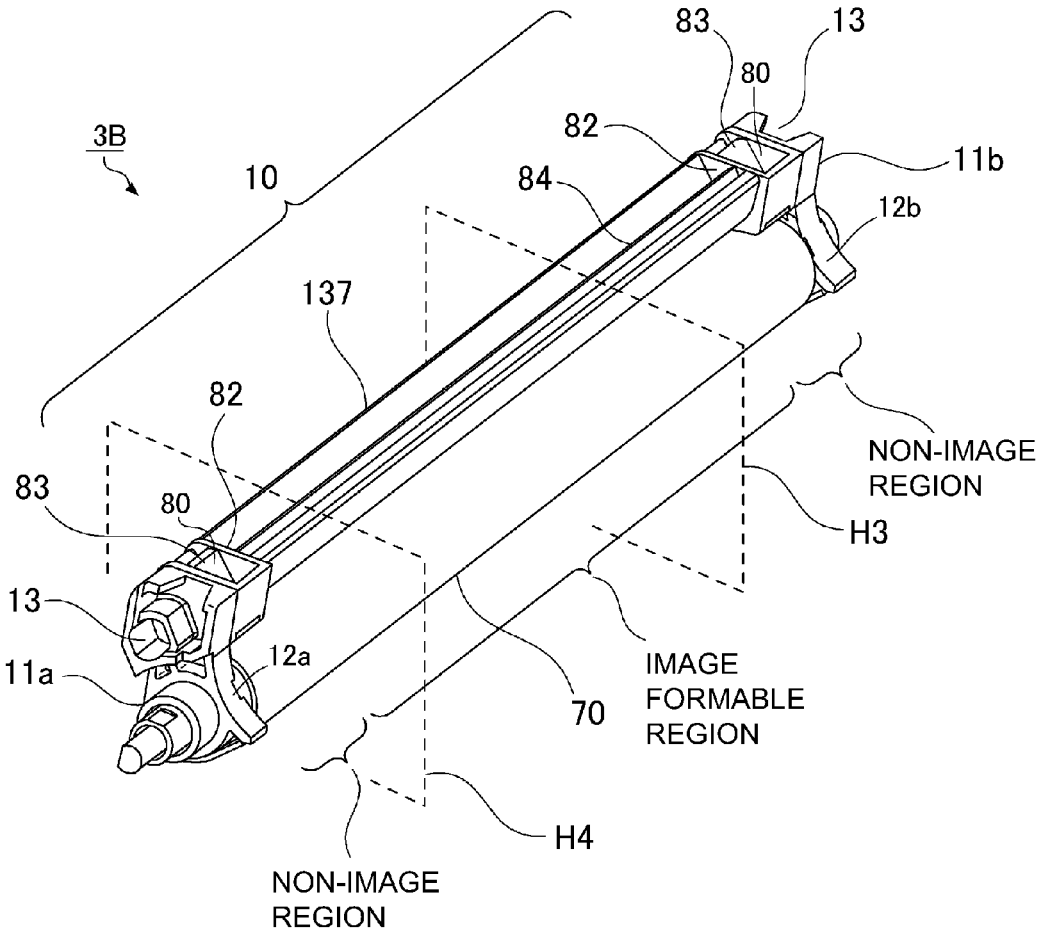
FIG. 6 is an illustration of a structure of a sleeve holder unit in Embodiment 2.

As shown in FIG. 6, the sleeve bearing members 11*a* and 11*b* and the regulating member 37 are integrally bonded to each other. Each of reinforcing ribs 84 is a rib extending in the rotational axis direction of the developing sleeve 70. Reinforcing ribs 82 are a pair of ribs each extending in the rotational direction of the developer carrying member (developing sleeve 70). The regulating member 37 is integrally molded by using a resin material so that a box-like shape in which a side opposite from an opposing surface to the developing sleeve 70 is open is formed by connecting the reinforcing ribs 84 with the reinforcing ribs 82. Each of the reinforcing ribs 82 also functions as a wall, of the opening 80, in a side closer to a center side with respect to the rotational axis direction.

(Feature of Embodiment 2)

Figure 7:
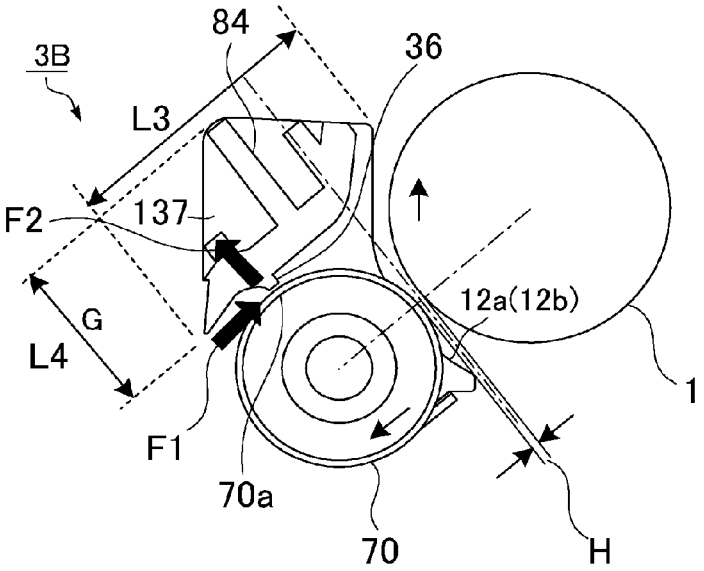
In FIG. 7, (a) and (b) are illustrations of an assembled state of the sleeve holder unit and a photosensitive drum.
Figure 7:
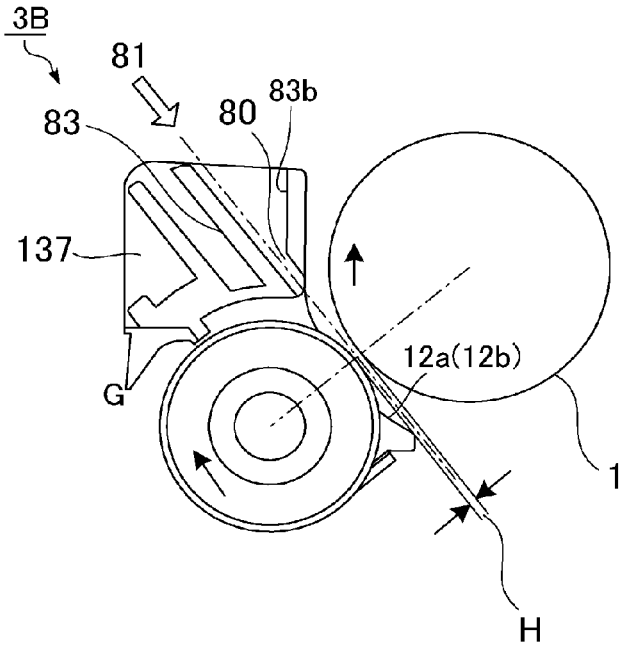

FIG. 6 is an illustration of a structure of a sleeve holder unit in Embodiment 2. In FIG. 7, (a) and (b) are illustrations of an assembled state of the sleeve holder unit and the photosensitive drum. In FIG. 7, (a) shows an operation during image formation in a cross-section in an image region, and (b) shows an operation during the image formation in a cross-section in a region outside the image region. A developing device 3B in this embodiment is constituted and operated similarly as in Embodiment 1 except that the regulating member 37 is resin-molded in a shape such that the reinforcing ribs are provided. For this reason, in FIGS. 6 and 7, constituent elements common to Embodiments 1 and 2 are represented by the same reference numerals or symbols as those in FIGS. 1 to 5, and will be omitted from redundant description.

As shown in FIG. 6, the developing sleeve 70, the sleeve bearing members 11*a* and 11*b* and a regulating member 137 which are formed as separate members are integrally assembled to constitute a sleeve holder unit 10. The regulating member 137 rotatably supports the developing sleeve 70 by the sleeve bearing members 11*a* and 11*b* provided at end portions thereof. The regulating member 137 is formed of a resin material by injection molding using a metal mold.

As shown in (a) of FIG. 7, in a cross-section H3 of FIG. 6, reaction forces F1 and F2 act on the layer thickness regulating portion 36 during the image formation. For this reason, the regulating member 136 is provided with the reinforcing rib 84 for reducing a degree of deformation of the layer thickness regulating portion 36 against the reaction forces F1 and F2.

As shown in FIG. 6, with respect to the image (formable) region of the photosensitive drum 1, the three reinforcing ribs 84 each having a rib shape continuously extending in a longitudinal direction of the regulating member 137 are formed as a part of the regulating member 137. At each of the end portions of the reinforcing ribs 84, in a non-image region outside the image region, a reinforcing rib 83 perpendicular to the longitudinal direction is connected, so that large geometrical moment of inertia of the regulating member 137 is ensured.

As shown in (a) of FIG. 7, the reinforcing ribs 84 positioned in the image region are disposed at positions where the reinforcing ribs 84 do not adversely affect accuracy of injection molding. The positions of the reinforcing ribs 84 are somewhat deviated from the back-side position of the layer thickness regulating portion 36 in the upstream side and the downstream side, respectively, with respect to the feeding develop. The reinforcing ribs 84 are disposed in parallel to the longitudinal direction of the regulating member 137, and do not cross the back-side position of the layer thickness regulating portion 36. For this reason, the deformation and a lowering in straightness of the layer thickness regulating portion 36 due to resin contraction after the injection molding are not readily generated.

The cross-section of each of the reinforcing ribs 84 projecting in the back side of the layer thickness regulating portion 36 is invariant at any longitudinal position. For this reason, warpage of the regulating member 137 due to the resin contraction after the injection molding is not readily generated. Each of the reinforcing ribs 84 has a cross-sectional shape, perpendicular to the longitudinal direction, which is extended in an L4 direction parallel to a direction of the reaction force F2, so that rigidity of the regulating member 137 against the reaction force F2 is enhanced. With respect to the regulating member 137, a cross-sectional shape perpendicular to the longitudinal direction is extended in an L3 direction parallel to a direction of the reaction force F1, so that rigidity of the regulating member 137 against the reaction force F1 is enhanced. The regulating member 137 is integrally formed with a developer rectifying portion 35, so that the rigidity of the regulating member 137 against the reaction force F1 is enhanced.

As shown in FIG. 6, in the non-image region of the regulating member 137, the pair of reinforcing ribs 82 extending in the toner feeding direction are connected, and a pair of reinforcing ribs 83 and outer wall ribs 83*b* perpendicular to the pair of reinforcing ribs 82 are disposed. The pair of reinforcing ribs 83 are disposed so as to connect between the reinforcing rib 82 for forming a bonding surface to the sleeve bearing member 11*a* and the reinforcing rib 82 connected with the reinforcing rib 84 positioned in the image region. The reinforcing ribs 82 are provided in the non-image region, and therefore even when a local lowering in straightness of the layer thickness regulating portion 36 is generated in the back side of the reinforcing ribs 82, the reinforcing ribs 82 do not influence an output image.

The reinforcing ribs 82, the reinforcing ribs 83 and the outer wall ribs 83*b* constitute a box-like shape formed of the resin in the non-image region. The reinforcing ribs 82 are provided outside the image formable region of the regulating member 137 to form the box-like shape at each of the end portions, of the regulating member 137, which are the non-image regions. The reinforcing ribs 83 inside the box-like shape are formed along a line-of-sight direction of the SD gap through between the photosensitive drum 1 and the developing sleeve 70. The reinforced box-like shape realizes sufficient rigidity and accuracy capable of withstanding the reaction forces F1 and F2 of the developer.

As shown in (b) of FIG. 7, in a cross-section H4 of FIG. 6, the pair of reinforcing ribs 83 are provided in parallel to the line-of-sight direction of the SD gap H which is the gap between the developing sleeve 70 and the photosensitive drum 1. One of the pair of reinforcing ribs 83 constitutes a wall surface of the opening 80 and penetrates through the regulating member 137. For that reason, an inclined surface of the reinforcing rib 83 functions as a guiding surface when the gap gage is inserted into the SD gap H as described in Embodiment 1. Through the opening 80, measurement of the SD gap H by laser light can be made.

The developing device 3B in Embodiment 2 has the cross-sectional shape extending in the longitudinal direction and the toner feeding direction as described above, and therefore each of the reinforcing ribs 84 in the image (formable) region and the reinforcing ribs 83 in the non-image region can be extended in a most effective direction. By providing the reinforcing rib 82 between the reinforcing rib 84 and the reinforcing rib 83, even in the case where the reinforcing rib 84 and the reinforcing rib 83 cannot provided on the same line, it is possible to ensure rigidity required for the regulating member 137.

(Effect of Embodiment 2)

The developing device 3B in Embodiment 2 is provided with the gap 80, in the non-image region as each of the end portions of the regulating member 137, capable of ensuring a sight line to the SD gap H from above. For this reason, in a state in which the photosensitive drum 1, the regulating member 137 and the developing sleeve 70 are incorporated in the developing device 3B, the SD gap H can be accurately adjusted without damaging the photosensitive drum 1 in the image region. The developing device 3B in Embodiment 2 is capable of providing a stable image density of the output image since the gap between the photosensitive drum 1 and the developing sleeve 70 can be adjusted with high accuracy.

In the developing device 3B in Embodiment 2, the regulating member 137 including the layer thickness regulating portion 36 is a molded product obtained by the injection molding of the resin material, and therefore a component cost of the image forming apparatus can be reduced by forming the regulating member 137 inexpensively compared with Embodiment 1. In the developing device 3B in Embodiment 2, while employing a simple and inexpensive constitution of the regulating member 137, by providing the reinforcing ribs 83, it is possible to ensure sufficient flexural rigidity of the regulating member 137 with respect to the toner feeding direction and a diameter direction of the developing sleeve 70.

In the developing device 3B in Embodiment 2, the regulating member 137 has the sufficient flexural rigidity with respect to the toner feeding direction and the diameter direction of the developing sleeve 70 and therefore a degree of variation in image density with respect to the longitudinal direction of the photosensitive drum 1 is decreased. In the developing device 3B in Embodiment 2, the straightness of the layer thickness regulating portion 36 can be set with high accuracy, and therefore the image density of the output image is stabilized, so that also a degree of variation in image density between the image forming apparatuses becomes small. In developing device 3B in Embodiment 2, by using the regulating member 137 which is the resin-molded product having high accuracy and high rigidity, it is possible to stably regulate the amount of the developer on the developing sleeve 70 in the simple and inexpensive constitution.

Embodiment 3

The present invention can be carried out also in other embodiments in which a part or all of constituent elements in the above-described embodiments are replaced with alternative constituent elements thereof so long as the regulating member form regulating the layer thickness of the developer is provided with the through hole through which the SD gap is visually recognizable. Accordingly, the present invention is not limited to the developing device using the two-component developer, but may also be carried out in a developing device using a one-component developer. The present invention is not limited to the developing device in the form of the process cartridge, but may also be carried out in a developing device capable of being mounted and dismounted alone for exchange. The present invention is not limited to the full-color image forming apparatus, but may also be carried out in a monochromatic image forming apparatus including the developing device or the process cartridge.

Constituent elements, other than the developing device, integrally assembled as the process cartridge may be arbitrarily selected. The process cartridge may also be prepared by integrally assembling the plurality of image forming portions into a unit. Further, in the above-described embodiments, only a principal portion relating to toner image formation and transfer is described, but the present invention can be carried out in image forming apparatuses, having various uses, such as printers, various printing machines, copying machines, facsimile machines, and multi-function machines, by adding necessary equipment, devices and casing structures.

Comparison Example 1

Figure 8:
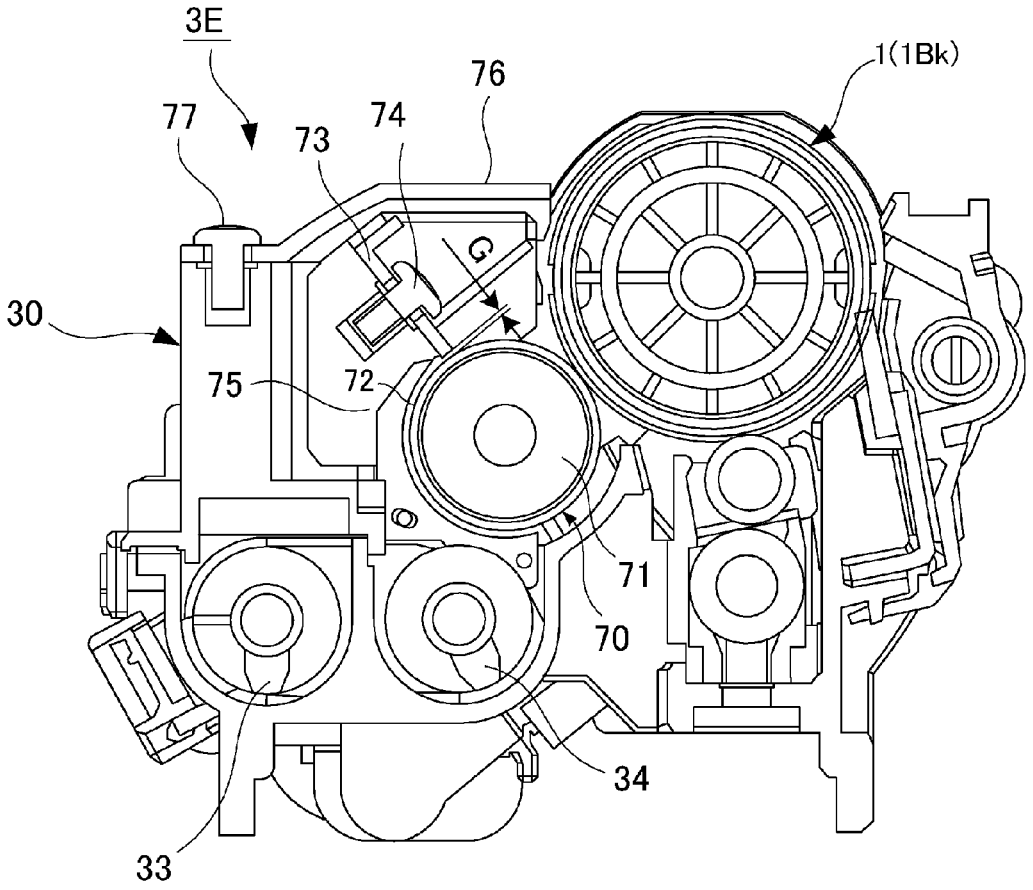
FIG. 8 is an illustration of a structure of a developing device in Comparison Example 1.

FIG. 8 is an illustration of a structure of a developing device 3E in Comparison Example 1. As shown in FIG. 8, in the developing device 3E in Comparison Example 1, a doctor blade 73 is formed of a metal material in a plate shape, and is fixed to a developer rectifying member 75 with fixing screws 74. A magnetic force of a magnet portion 71 deposits the developer on the surface of a developing sleeve 70. The doctor blade 73 uniformizes a layer thickness of the developer on the surface of the developing sleeve 70, so that stable developer supply to an electrostatic image on a photosensitive drum 1 is realized.

In the developing device 3E in Comparison Example 1, the doctor blade 73 is deformed by a force generated when the doctor blade 73 uniformizes a developer coating amount on the surface of the developing sleeve 70 in the SB gap G. The SB gap G is displaced in a remote direction from the developing sleeve 70 at a longitudinal central portion of the developing sleeve 70, and therefore the developer coating amount with respect to the longitudinal direction of the developing sleeve 70 cannot become uniform, thus causing image density non-uniformity.

In recent years, the developing device 3E is required to be reduced in weight and the number of components. Therefore, the doctor blade 73, of the metal material, which has been used as a single layer thickness regulating member is required to be integrally formed of the resin material with the developer rectifying member 35.

Comparison Example 2

Figure 9:
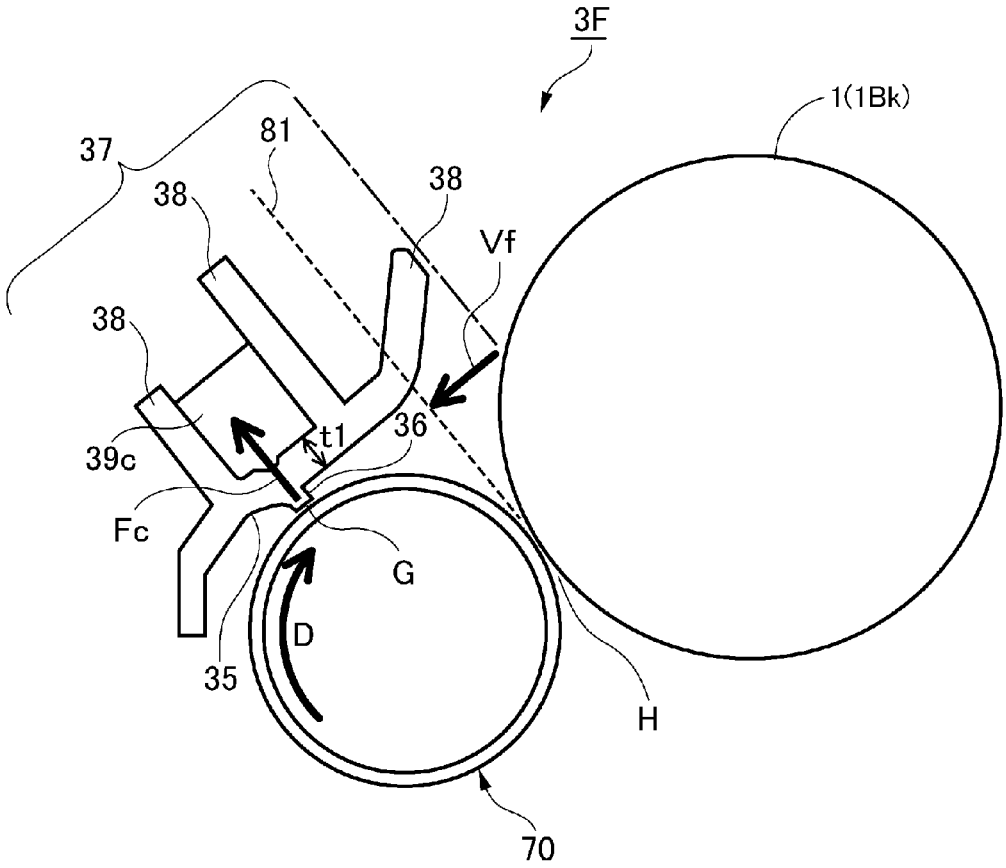
FIG. 9 is an illustration of a structure of a developing device in Comparison Example 2.

FIG. 9 is an illustration of a structure of a developing device 3F in Comparison Example 2. As shown in FIG. 9, in the developing device 3F Comparison Example 2, a regulating member 37 is formed as a molded product of a resin material as a whole, and is provided with a layer thickness regulating portion 36 for regulating a layer thickness of a developer by defining an SB gap G with a developing sleeve 70.

In the back side of the layer thickness regulating portion 36, as a reinforcing means for the regulating member 37, reinforcing ribs 83 continuously extending in the longitudinal direction of the regulating member 37. Each of the reinforcing ribs 83 is, in order to ensure rigidity against a force Fc applied from the developer to the layer thickness regulating portion 36 when the developer passes through the layer thickness regulating portion 36, disposed over an entire area with respect to the longitudinal direction, so that a large cross-sectional area is ensured.

The regulating member 37 formed of the resin material is prepared by assembling respective components at a high density for the purpose of realizing a large cross-sectional area and downsizing of the developing device, and therefore it is difficult to ensure a line-of-sight space for measuring an SD gap H.

According to the developing device of the present invention, through the opening newly added in the present invention, the gap where the image bearing member and the developer carrying member oppose each other can be visually recognized from the outside of the regulating member. Accordingly, even in the case where the cross-section of the layer thickness regulating beam member is extended to the position close to the image bearing member, in a state in which the layer thickness regulating member is assembled with the developing device, it is possible to check and adjust the gap between the image bearing member and the developer carrying member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 166633/2013 filed Aug. 9, 2013, which is hereby incorporated by reference.

What is claimed is:

1. A developing device for developing a latent image on an image bearing member comprising:

a rotatable developer carrying member configured to carry a toner;

a first bearing member, provided at one end of said developer carrying member, configured to rotatably support said developer carrying member;

a second bearing member, provided at the other end of said developer carrying member, configured to rotatably support said developer carrying member;

a regulating member configured to regulate an amount of a developer carried on said developer carrying member, said regulating member comprising:

a base portion;

a regulating portion, extending along a rotational axis direction of said developer carrying member, configured to project from a first surface of said base portion and configured to regulate a layer thickness of a developer;

a first supporting portion, provided at one end of said base portion with respect to the rotational axis direction, configured to support said first bearing member;

a second supporting portion, provided at the other end of said base portion with respect to the rotational axis direction, configured to support said second bearing member;

a first through hole structure which is provided outside a maximum image forming region where an image is formable on the image bearing member and inside said first supporting portion with respect to the rotational axis direction and which is provided so as to oppose a gap between the image bearing member and said developer carrying member;

a second through hole structure which is provided outside the maximum image forming region and inside said second supporting portion with respect to the rotational axis direction and which is provided so as to oppose the gap between the image bearing member and said developer carrying member; and a first rib which projects from a second surface opposite from the first surface of said base portion and which extends from said one end to said the other end along the rotational axis direction;

a second rib, extending from one end of said first rib in a substantially perpendicular direction to said first rib, configured to form part of said first through hole structure; and a third rib, extending from the other end of said first rib in a substantially perpendicular direction to said first rib, configured to form part of said second through hole structure.

2. A developing device according to claim 1, wherein said regulating portion extends from said one end to said the other end.

* * * * *